US006648717B1

(12) United States Patent
Dignitti et al.

(10) Patent No.: US 6,648,717 B1
(45) Date of Patent: Nov. 18, 2003

(54) ADJUSTABLE HOOP AND METHOD OF USING THE SAME

(75) Inventors: Daniel Dignitti, Hamburg, NY (US); David E. Moomaw, East Aurora, NY (US); Gerald P. Sitarski, Grand Island, NY (US); Mark Andre Wojtkiewicz, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/141,913

(22) Filed: May 10, 2002

(51) Int. Cl.[7] ..... A63H 33/00

(52) U.S. Cl. ..... 446/236; 446/28; 428/66.6; 428/36.9

(58) Field of Search ..... 428/66.6, 36.9; 446/236, 28; 403/292

(56) References Cited

U.S. PATENT DOCUMENTS

| | | | |
|---|---|---|---|
| 3,348,333 | A | 10/1967 | Cascioli |
| 3,409,224 | A | 11/1968 | Harp et al. |
| 3,645,038 | A | 2/1972 | Morrison et al. |
| 3,729,860 | A | 5/1973 | Kargul |
| 4,215,510 | A | 8/1980 | Worrell |
| 4,380,885 | A | 4/1983 | Komagata |
| 4,579,538 | A | 4/1986 | Bass et al. |
| 5,261,756 | A | 11/1993 | Kohn |
| 5,338,244 | A | 8/1994 | Huang |
| 5,395,278 | A | 3/1995 | Dickhut |
| 5,569,134 | A | 10/1996 | Nordanger |
| D399,969 | S | 10/1998 | Lin |
| 5,823,846 | A | 10/1998 | Arriola et al. |
| 5,895,309 | A | 4/1999 | Spector |
| 6,059,632 | A | 5/2000 | Sassak |
| 6,102,769 | A | 8/2000 | Huang |
| 6,109,999 | A | 8/2000 | Kuo |
| D442,233 | S | 5/2001 | Seo |
| D442,234 | S | 5/2001 | Seo |
| D443,002 | S | 5/2001 | Seo |
| D445,146 | S | 7/2001 | Seo |
| D445,463 | S | 7/2001 | Seo |
| 6,450,854 | B1 | 9/2002 | Fireman et al. |
| 6,482,136 | B1 | 11/2002 | Kessler |

FOREIGN PATENT DOCUMENTS

| | | |
|---|---|---|
| WO | WO 94/17859 | 8/1994 |
| WO | WO 00/64541 | 11/2000 |

*Primary Examiner*—Alexander S. Thomas
(74) *Attorney, Agent, or Firm*—Cooley Godward LLP

(57) ABSTRACT

A hoop having an adjustable diameter and including a fixed portion and an adjustable portion. The adjustable portion can be disposed in an extended configuration and a collapsed configuration. A user can vary the diameter of the hoop by moving a first end of the adjustable member with respect to a second end of the adjustable member.

21 Claims, 11 Drawing Sheets

ADJUSTABLE HOOP AND METHOD OF USING THE SAME

TECHNICAL FIELD

This invention relates to an adjustable hoop, and more particularly, to a hoop that includes a mechanism for adjusting the diameter of the hoop.

BACKGROUND OF THE INVENTION

Children enjoy toys that allow them to move their bodies to interact with the toy. Thus, hoops, such as those sold under the registered trademark "Hula-Hoop", have consistently been popular toys.

Conventional hoops include a circular member that can be manipulated by a user to rotate around the waist of the user. It can be difficult for users of different sizes and skills to use the same hoop. For some hoops, as the diameter of the hoop increases, manipulation and use of the hoop becomes easier. Alternatively, as the diameter of the hoop decreases, manipulation and use of the hoop becomes more difficult.

Some conventional hoops include mechanisms for adjusting the sizes of the hoops. These conventional hoops, however, are difficult to adjust and can only be adjusted to relatively few discrete sizes.

SUMMARY OF THE INVENTION

A hoop includes an arcuate member and an adjustable member coupled together. The hoop is disposable in multiple configurations, in each of which the hoop has a different diameter or size. The adjustable member is likewise selectively disposable in several configurations, including extended configurations and collapsed configurations. The adjustable member is longer in its extended configurations than in its collapsed configurations. When the length of the adjustable member changes, the overall diameter of the hoop changes. The adjustable member facilitates the adjustment of the hoop to multiple sizes for multiple users. The adjustable member also allows for adjustment of the hoop to multiple sizes for a single user, which enables a user to play with the hoop at different speeds. In one embodiment, the adjustable member includes an outer tube and an inner tube. In an alternative embodiment, the adjustable member includes only an outer tube.

DETAILED DESCRIPTION OF THE INVENTION

Figure 1:
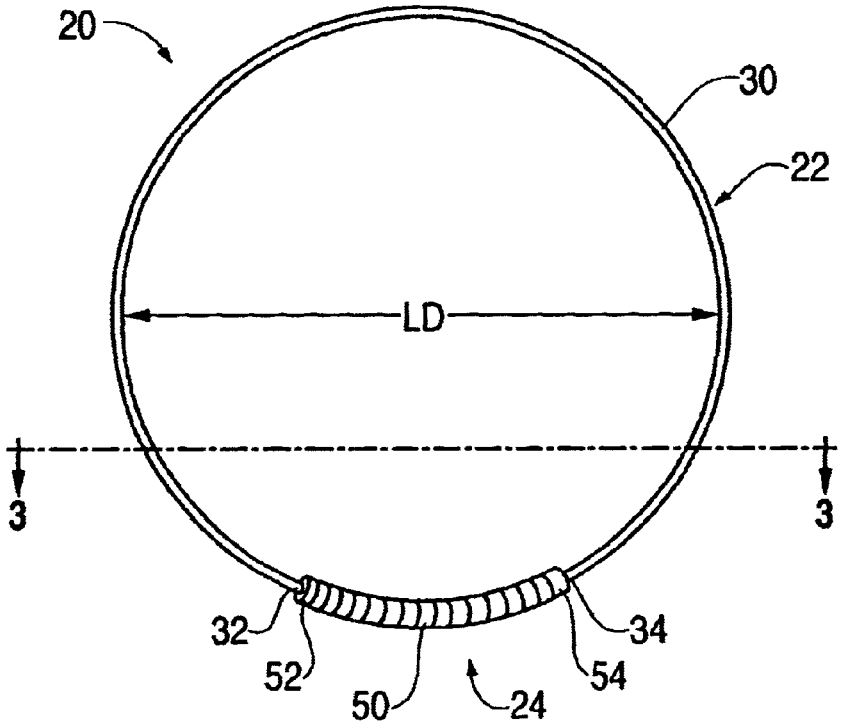
FIG. 1 illustrates a top view of an embodiment of a hoop in an expanded configuration in accordance with the present invention.

A hoop includes an arcuate member and an adjustable member coupled together. The hoop is disposable in multiple configurations, in each of which the hoop has a different diameter or size. The adjustable member is likewise selectively disposable in several configurations, including extended configurations and collapsed configurations. The adjustable member is longer in an extended configuration than in a collapsed configuration. When the length of the adjustable member changes, the overall diameter of the hoop changes. The adjustable member facilitates the adjustment of the hoop to multiple sizes for multiple users. The adjustable member also allows for adjustment of the hoop to multiple sizes for a single user, which enables a user to play with the hoop at different speeds. In one embodiment, the adjustable member includes an outer tube and an inner tube. In an alternative embodiment, the adjustable member includes only an outer tube.

An embodiment of a hoop in accordance with the present invention is illustrated in FIGS. 1–6. The hoop 20 resembles a substantially annular body that includes an fixed portion or length member 22 and an adjustable portion or length member 24. The fixed portion 22 has a fixed length and the adjustable portion 24 has a length that is adjustable by the user. The circumference or overall length of the hoop 20 can be adjusted to change the diameter of the hoop 20. Accordingly, the hoop 20 can be placed in multiple configurations having different sizes, including an expanded configuration and a collapsed configuration.

Figure 2:
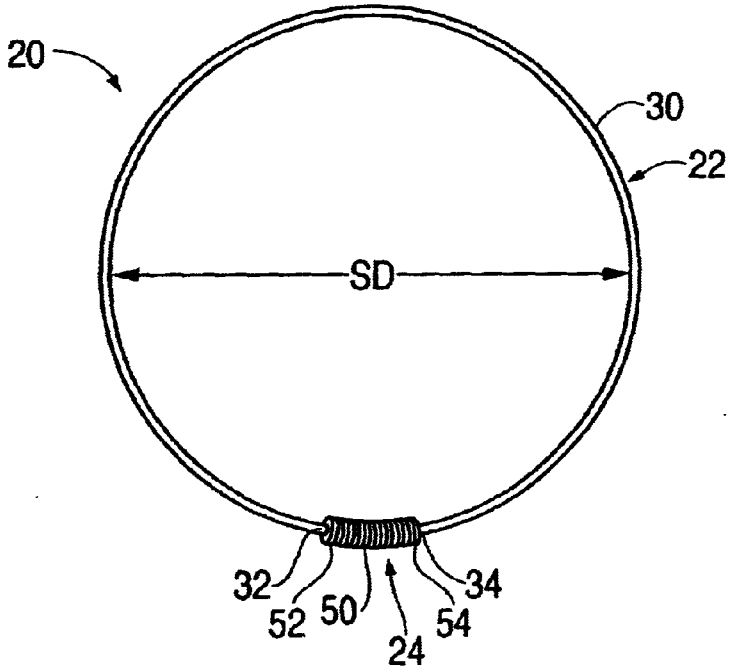
FIG. 2 illustrates a top view of the hoop of FIG. 1 in a collapsed configuration.

In the illustrated embodiment, the adjustable portion 24 can be disposed in numerous configurations in which the overall length of the adjustable portion varies. The adjustable portion 24 can be disposed in an expanded configuration, as illustrated in FIG. 1, and in a collapsed configuration, as illustrated in FIG. 2. The diameter LD of the hoop 20 when the adjustable portion 24 is in its expanded configuration is larger than the diameter SD of the hoop 20 when the adjustable portion 24 is in its collapsed configuration.

The fixed portion 22 includes an arcuate member 30 that has a first end 32 and a second end 34. In the illustrated embodiment, the arcuate member 30 is a hollow tube that has an inner surface 42 that defines a cavity 40 with a diameter 44 (see FIG. 6). In an alternative embodiment, the arcuate member 30 can be a solid cylindrical member.

In the illustrated embodiment, the adjustable portion 24 includes an adjustable member 50, which can be placed into shapes or configurations having different lengths. The adjustable member 50 can retain its configuration after adjustment by a user. The adjustable member 50 has a first end 52 and a second end 54. The first end 52 of the adjustable member 50 is coupled to the first end 32 of the arcuate member 30. Similarly, the second end 54 of the adjustable member 50 is coupled to the second end 34 of the arcuate member 30. In the illustrated embodiment, the arcuate member 30 and the adjustable member 50 form a complete circle.

Figure 3:
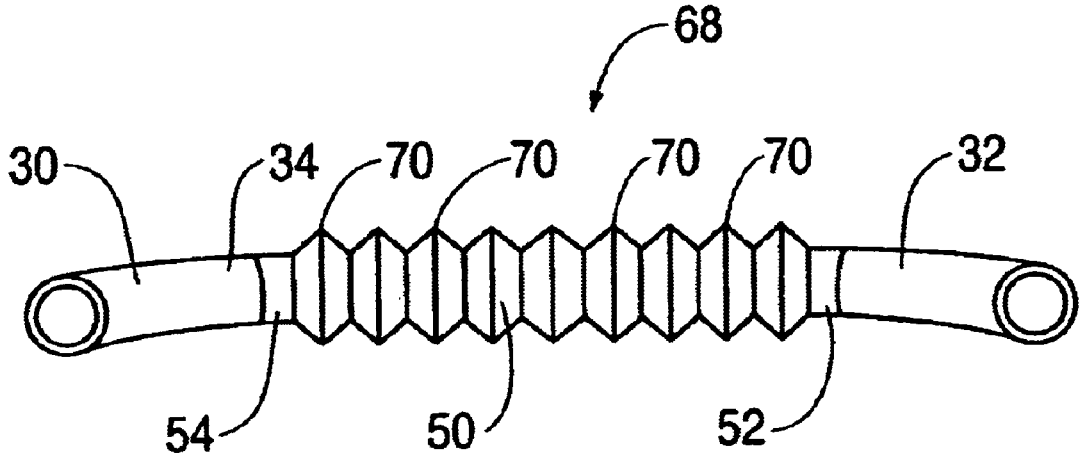
FIG. 3 illustrates a cross-sectional view of the hoop of FIG. 1 taken along the line 3—3 in FIG. 1.

An embodiment of an adjustable member is illustrated in FIG. 3. As illustrated, the adjustable member 50 includes a corrugated portion or section 68 that has several corrugations 70. While a particular number of corrugations is illustrated, the adjustable member can include any number of corrugations to allow for adjustment of the length of the adjustable member 50. Any combination of the corrugations may be collapsed inside one another to change the length of the adjustable member 50.

Figure 4:
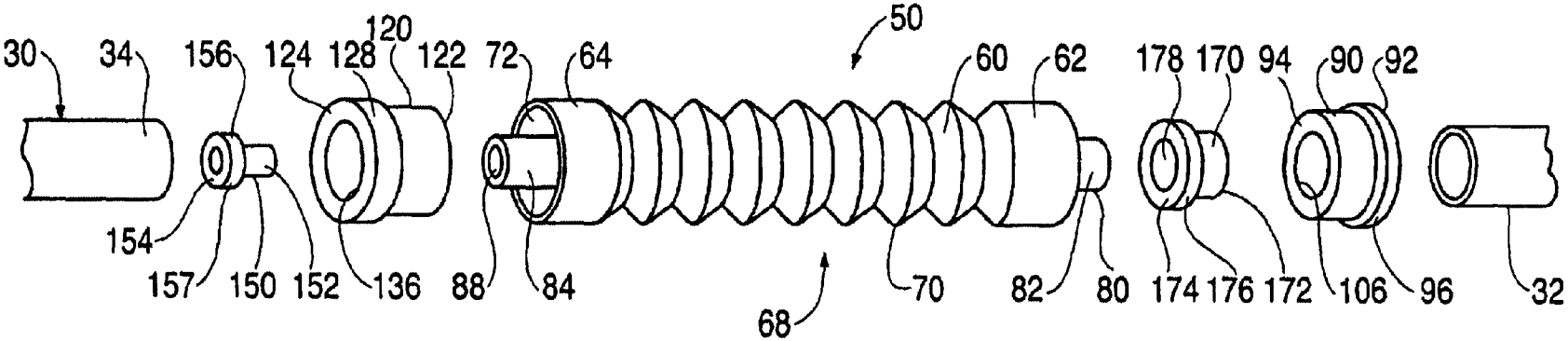
FIG. 4 illustrates an exploded perspective view of an embodiment of an adjustable member of the hoop of FIG. 1.
Figure 5:
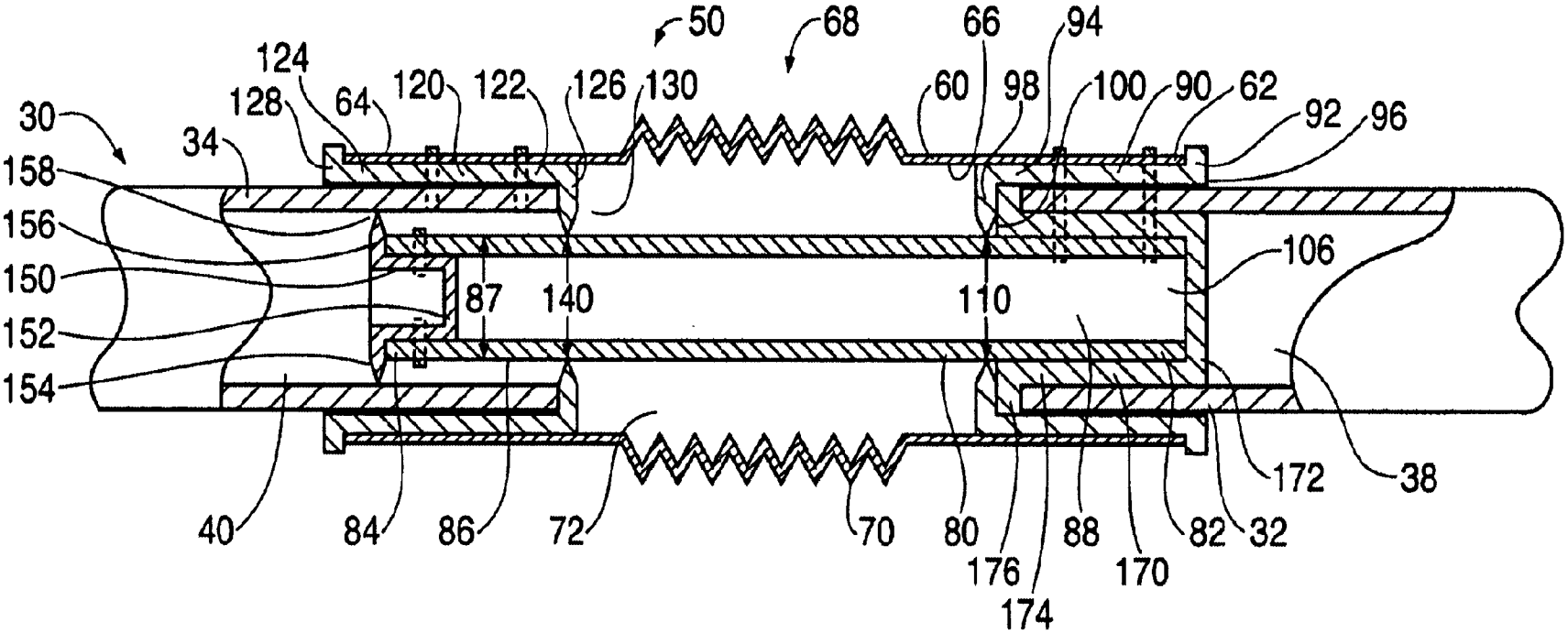
FIG. 5 illustrates a cut-away side view of the adjustable member of FIG. 4 in a collapsed configuration.
Figure 6:
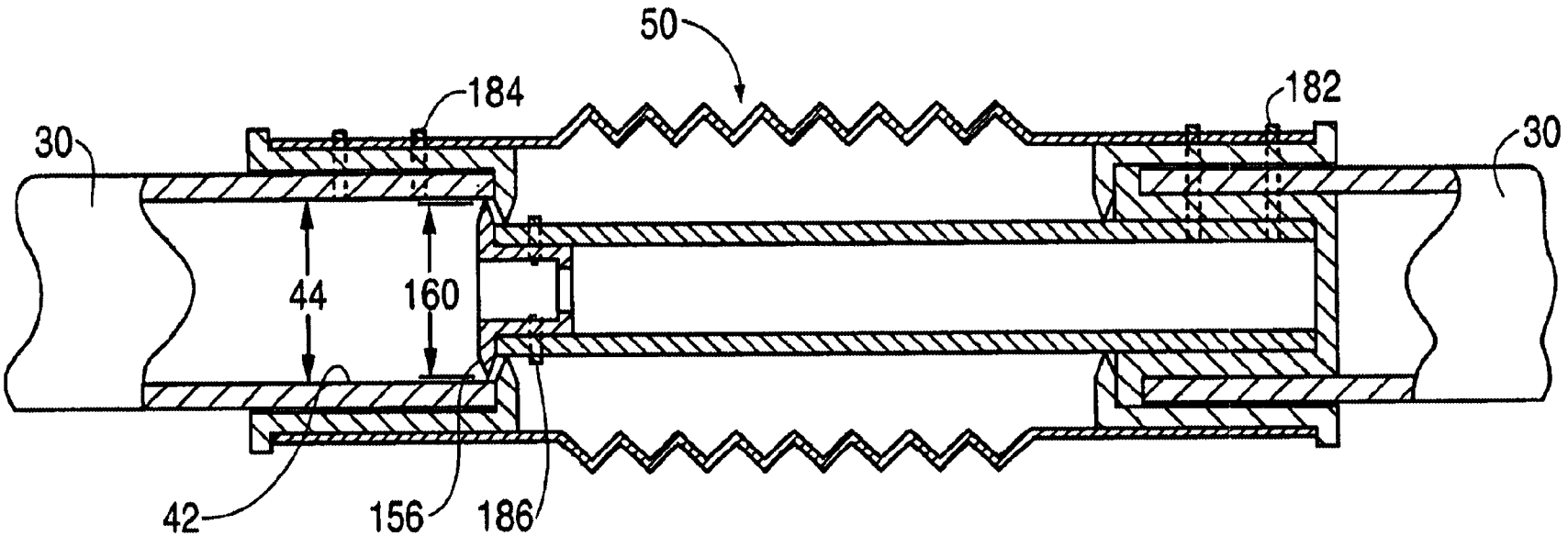
FIG. 6 illustrates a cut-away side view of the adjustable member of FIG. 4 in an expanded configuration.

The relevant components of the adjustable member 50 are illustrated in FIGS. 4–6. The adjustable member 50 includes an outer tube 60 and an inner tube 80. The outer tube 60 has a variable length and the inner tube 80 has a fixed length. Referring to FIGS. 4 and 5, the outer tube 60 has a first end 62, a second end 64, an inner surface 66, and an internal cavity or passageway 72 defined by the inner surface 66 that extends between the first and second ends 62 and 64. The ends 62 and 64 of the outer tube 60 are coupled to ends 32 and 34 of the arcuate member 30, respectively. Any conventional form of connection may be used to couple the corresponding ends together, including mechanical fasteners, adhesives, welding, etc.

In the illustrated embodiment, sleeves 90 and 120 are coupled to the ends 32 and 34 of the arcuate member 30, respectively. Sleeve 90 includes ends 92 and 94, flanges 96 and 98, and defines a passageway 106, therethrough. Sleeve 120 includes ends 122 and 124, flanges 126 and 128, and defines a passageway 136, therethrough. Flanges 98 and 126 define openings that have inner diameters 110 and 140, respectively (see FIG. 5). While flanges 98 and 126 are illustrated as including tapered portions 100 and 130, it is not necessary that the flanges have tapered portions.

As illustrated in FIGS. 5–6, the first end 32 of the arcuate member 30 is disposed within the passageway 106 of sleeve 90. Similarly, the second end 34 of the arcuate member 30 is disposed within the passageway 136 of sleeve 120.

In the illustrated embodiment, the ends 32 and 34 of the arcuate member 30 and a portion of each of the sleeves 90 and 120 are disposed within the passageway 72 of the outer tube 60. Flange 96 of sleeve 90 and flange 128 of sleeve 120 extend out of and abut the ends 62 and 64 of the outer tube 60, respectively. Flanges 96 and 128 extend radially inwardly. In an alternative embodiment, the sleeves 90 and 120 can be entirely disposed within the passageway 72. In another embodiment, the ends 32 and 34 of the arcuate member 30 can terminate outside of the passageway 72 and be coupled to the outer tube 60 via a portion of the sleeves 90 and 120, respectively.

The inner tube 80 of the adjustable member 50 is semi-rigid and is configured to be disposed within the passageway 72 of the outer tube 60. The inner tube 80 has a fixed length and includes a first end 82, a second end 84, and a passageway 88 that extends between the ends 82 and 84. The inner tube 80 also includes an outer surface 86 that defines an outer diameter 87 of the tube 80 (see FIG. 5).

Referring to FIG. 4, the adjustable member 50 includes a cap 170 coupled to the first end 82 of the inner tube 80. The cap 170 includes a first end 172, a second end 174, a flange 176 located proximate to the second end 174, and an opening 178. The flange 176 extends radially outwardly.

When the components of the hoop are assembled, the first end 82 of the inner tube 80 is disposed within the opening 178 of the cap 170. In the illustrated embodiment, the first end 82 of the inner tube 80, the cap 170, the first end 32 of the arcuate member 30, and the sleeve 90 are fixedly coupled together via a common fastener. Alternatively, the first end 82 of the inner tube 80 could be fixedly coupled to the cap 170, which is fixedly coupled to the first end 32 of the arcuate member 30. The first end 82 of the inner tube 80 and a portion of the cap 170 are disposed within a portion of the interior of the arcuate member 30 proximate to the first end 32. The flange 176 of the cap 170 extends out of and abuts the first end 32 of the arcuate member 30 as illustrated in FIG. 5.

In an alternative embodiment, the first end 82 of the inner tube 80 and the cap 170 can be entirely disposed within the cavity 38. In another embodiment, the first end 82 of the inner tube 80 is sized so that there is no gap between the inner tube 80 and the arcuate member 30, thereby eliminating any need for a cap or other spacer.

The adjustable member 50 includes a plug 150 coupled to the second end 84 of the inner tube 80. As illustrated in FIG. 4, the plug 150 includes a first end 152, a second end 154, and a flange 156 located proximate to the second end 154. The flange 156 extends radially outwardly. The outer perimeter 157 of the flange 156 defines a diameter 160 (see FIG. 6). In the illustrated embodiment, a portion of the plug 150 is disposed within the passageway 88 of the inner tube 80. The flange 156 extends outwardly from the second end 84 of the inner tube 80.

In an alternative embodiment, the plug 150 can be disposed proximate to the second end 84 and coupled to the outer surface of the second end 84 of the inner tube 80. In this arrangement, the plug 150 is disposed entirely outside of the passageway 88 of the inner tube 80 and the flange or sleeve 120 is appropriately sized.

Referring to FIGS. 5 and 6, the inner tube 80 is coupled to the arcuate member 30 for relative movement thereto. In the illustrated embodiment, the second end 84 of the inner tube 80 is slidably coupled to the second end 34 of the arcuate member 30. The inner tube 80 is inserted into the cavity 40 of the arcuate member 30. In particular, the second end 84 of the inner tube 80 extends into the cavity 40. The outer diameter 160 of flange 156 is substantially the same as the inner diameter 44 of the inner surface 42 of the arcuate member 30 (see FIG. 6). Similarly, the inner diameter 140 of the flange 126 of the sleeve 120 is substantially the same as the outer diameter 87 of the outside surface 86 of the inner tube 80 (see FIG. 5).

To shorten the length of the adjustable member 50 and decrease the diameter of the hoop 20, a user can move the ends 32 and 34 of the arcuate member 30 toward each other. This movement will force some of the corrugations 70 to collapse and shorten the outer tube 60. At the same time, the inner tube 80 moves further into the cavity 40 of the arcuate member 30 to a position as illustrated in FIG. 5.

In one embodiment, the strength of the corrugated portion 68 of the outer tube 60 provides sufficient rigidity to retain the adjustable member 50 and the hoop 20 in selected configurations and prevents undesired shortening or lengthening of the adjustable member 50. In this arrangement, the inner tube 80 functions only as a guide.

In another embodiment, the frictional forces between the plug flange 156 and the arcuate member inner surface 42 and between the sleeve flange 126 and the inner tube outer surface 86 provide stability to retain the hoop in a particular configuration. In this arrangement, the outer tube is a protective covering or shroud. In another embodiment, the combination of the strength of the corrugated portion and the frictional forces described above provide stability to retain the hoop in a particular configuration.

To lengthen the adjustable member 50 and increase the diameter of the hoop 20, a user can move the ends 32 and 34 of the arcuate member 30 away from each other. This movement will expand some or all of the collapsed corrugations and lengthen the outer tube 60. The inner tube 80 then moves with respect to the arcuate member 30 so that less of the inner tube extends into the cavity 40 of the arcuate member 30 (see FIG. 6). The plug flange or retaining member 156 is sized to contact the flange or retaining member 126 of sleeve 120 to slidably couple the fixed length member 22 and the adjustable length member 24 to retain at least a portion of the inner tube 80 within the arcuate member cavity 40. This arrangement also limits the extent to which the adjustable portion 50 can be lengthened. While the flange 156 is illustrated as including a tapered portion 158, the tapered portion is not necessary.

Conventional coupling mechanisms can be used to couple the various components of the hoop 20. In the illustrated embodiment, staples 182, 184, and 186 extend through and fixedly secure various combinations of the outer tube 60, sleeves 90 and 120, plug 150, arcuate member 30, cap 170, and inner tube 80 together. In alternative embodiments, the coupling mechanisms can be any type of couplers or fasteners, such as clips, buttons, adhesives, or other items which couple the various components of the hoop 20 together.

Figure 7:
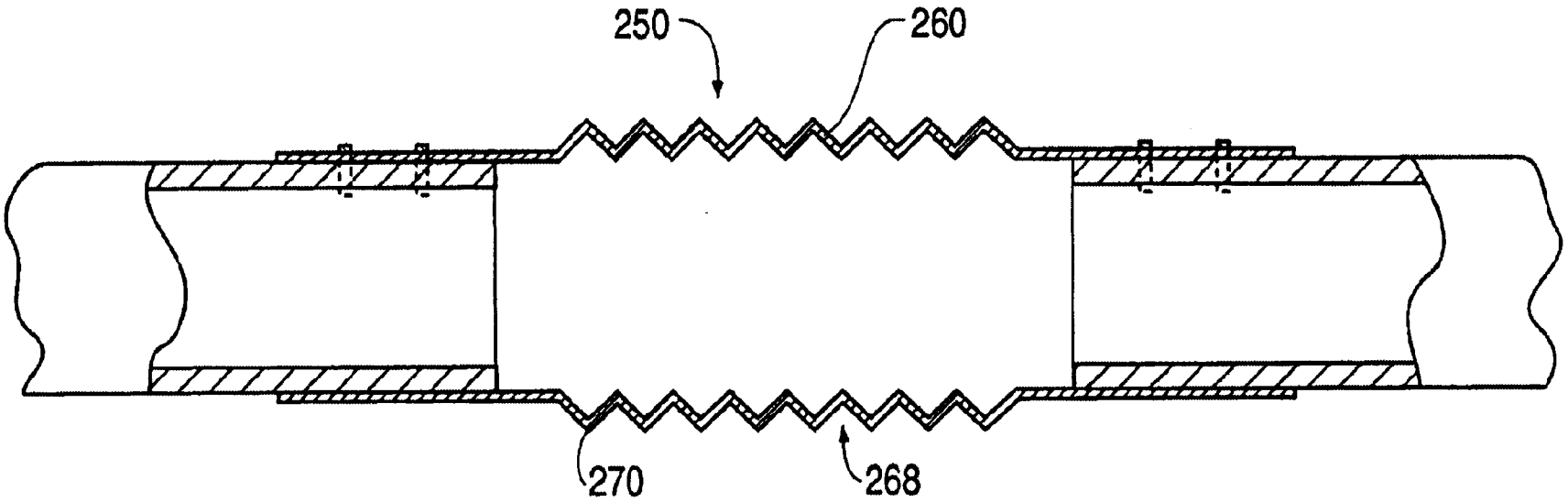
FIG. 7 illustrates a cut-away side view of an alternative embodiment of an adjustable member of a hoop in accordance with the present invention.
Figure 8:
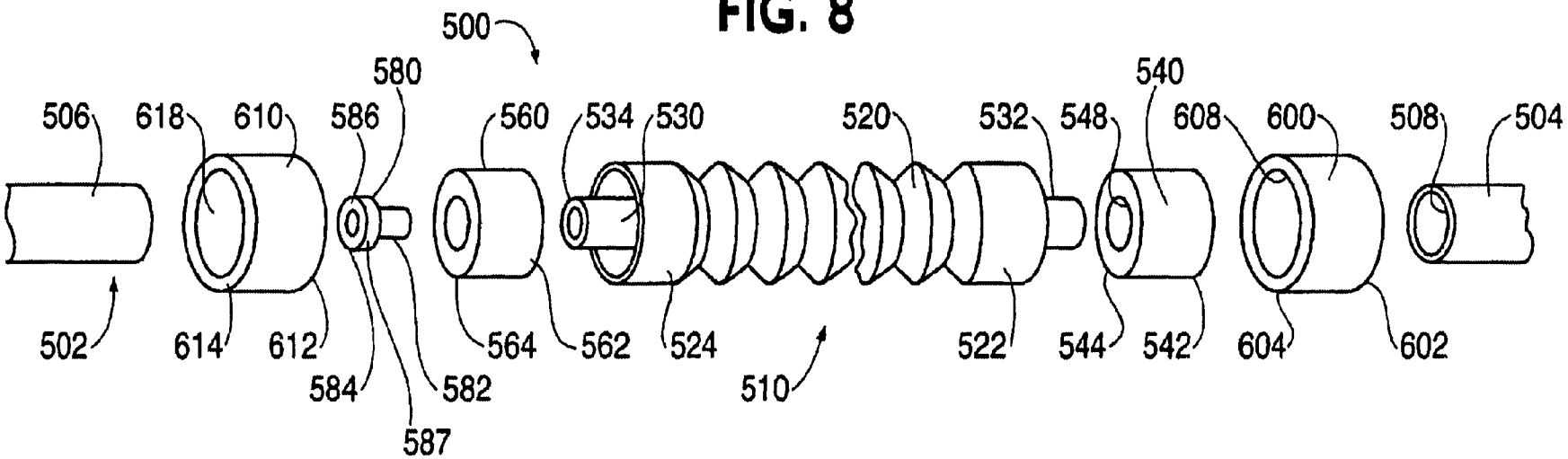
FIG. 8 illustrates an exploded perspective view of an alternative embodiment of an adjustable member of a hoop in accordance with the present invention.

An alternative embodiment of a hoop in accordance with the present invention is illustrated in FIG. 7. In this embodiment, the adjustable member 250 includes only an outer tube 260. Similar to the outer tube 60 described above, the outer tube 260 includes a corrugated portion 268 and several corrugations 270 that allow the outer tube 260 to be disposed in different lengths. To adjust the diameter of the hoop, the user applies force to the ends of the outer tubes 260 to collapse or extend the corrugations 270 in any desired manner. In this embodiment, the strength of the corrugated portion 268 of the outer tube 260 provides sufficient rigidity to retain the hoop in particular configurations.

An alternative embodiment of a hoop in accordance with the present invention is illustrated in FIGS. 8–15. The hoop 500 includes an arcuate member 502 coupled at both ends to an adjustable member 510. In this embodiment, the arcuate member 502 is a hollow, semi-rigid tube that has a first end 504, a second end 506, an inner surface 509, and a cavity 508 extending therethrough.

The adjustable member 510 includes several components that are used to lengthen and shorten the overall length of the adjustable member 510, thereby changing the diameter of the hoop 500. When coupled together, the arcuate member 502 and the adjustable member 510 form a complete circle.

The adjustable member 510 includes an outer tube 520 and an inner tube 530. The outer tube 520 is manipulated into various configurations to select a desired length of the adjustable member 510. The inner tube 530 is located within outer tube 520 and provides support for the adjustable member 510 and limits the range over which the outer tube 520 can be lengthened.

The outer tube 520 has a variable length, and the inner tube 530 has a fixed length. In this embodiment, the outer tube 520 has a first end 522, a second end 524, and an internal cavity or passageway 527 that extends between the ends 522 and 524 (see FIGS. 8–9). The outer tube 520 also includes a corrugated portion 516 that has several corrugations 517.

The ends 522 and 524 of the outer tube 520 are coupled to ends 504 and 506 of the arcuate member 502, respectively. In particular, end 522 is fixedly coupled to end 504 of the arcuate member 502 and end 524 is fixedly coupled to end 506 of the arcuate member 502. In one embodiment, the ends 522 and 524 of the outer tube 520 are partially disposed within the cavity 508 of the arcuate member 502. In an alternative embodiment, the ends 522 and 524 are not disposed within the cavity 508.

In this embodiment, the inner tube 530 of the adjustable member 510 is a semi-rigid tube that is disposed within the passageway 527 of the outer tube 520. The inner tube 530 has a fixed length and includes a first end 532, a second end 534, and a passageway 536 that extends between the ends 532 and 534. The inner tube 530 also includes an outer surface 538 that defines an outer diameter 539 of the inner tube 530.

Figure 9:
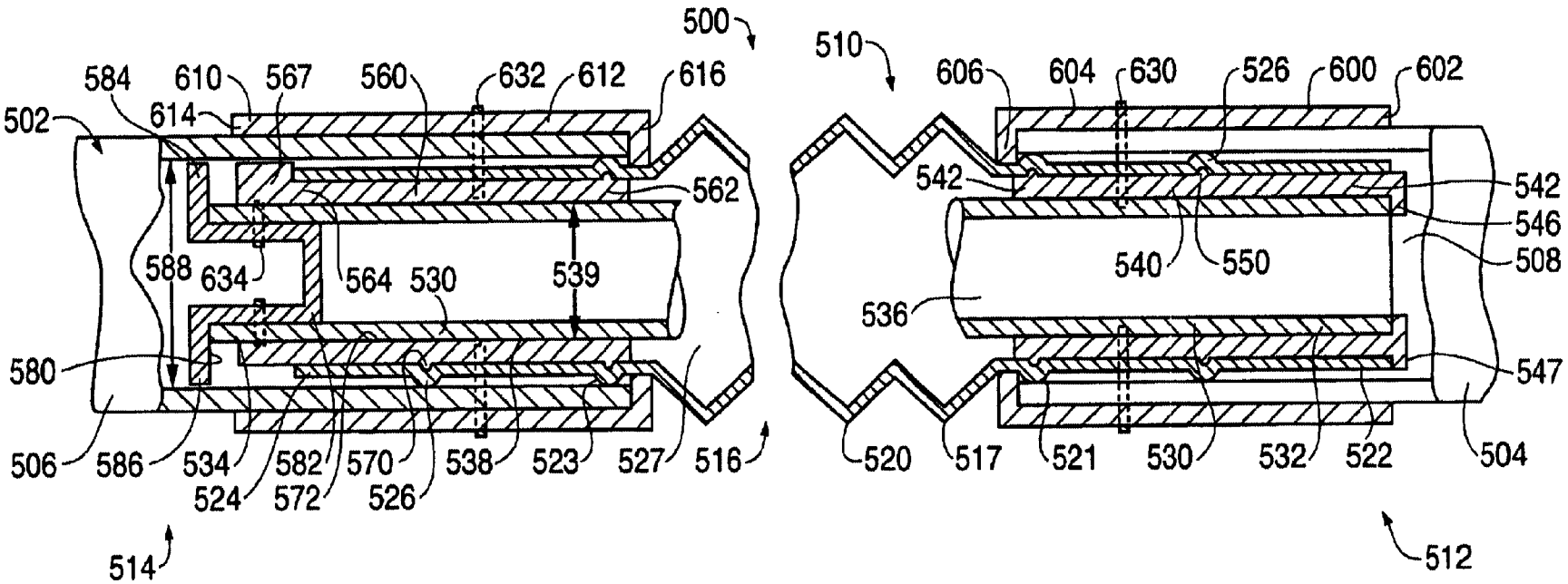
FIG. 9 illustrates a cut-away side view of the adjustable member of FIG. 8 in an expanded configuration.

As illustrated in FIG. 9, the adjustable member 510 includes inner sleeves 540 and 560. The outer diameter of tube 530 is less than the inner diameter of tube 520, thereby creating an annular space between the ends of tubes 520 and 530. Each inner sleeve 540 and 560 is located in the annular spaces formed between the ends of the outer tube 520 and the inner tube 530. In this arrangement, inner sleeve 540 is located between end 522 of the outer tube 520 and end 532 of inner tube 530. Inner sleeve 560 is located between end 524 of the outer tube 520 and end 534 of the inner tube 530.

Figure 13:
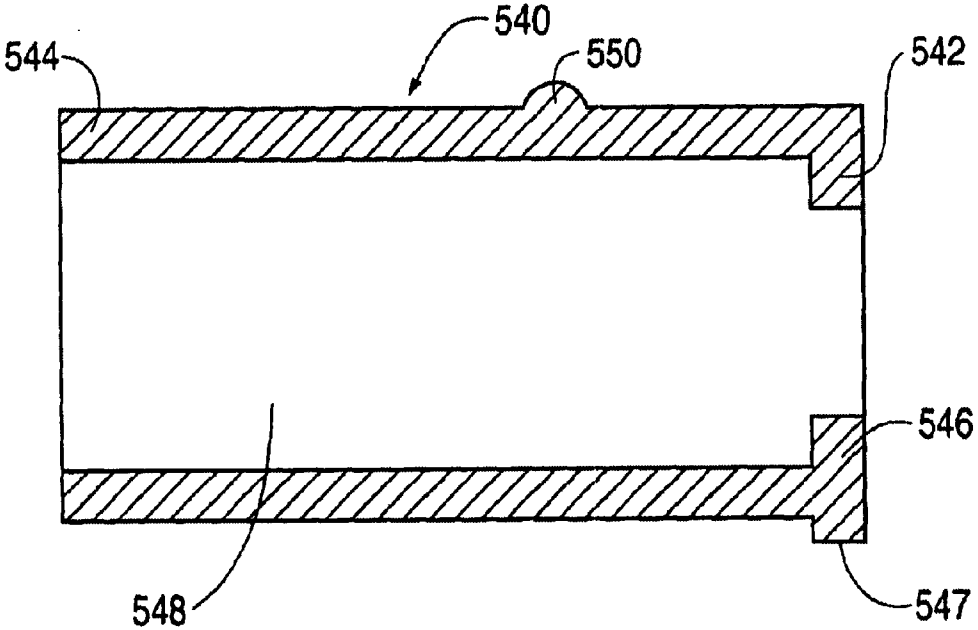
FIG. 13 illustrates a cross-sectional side view of the first inner sleeve of FIG. 12 taken along the line 13—13 in FIG. 12.
Figure 12:
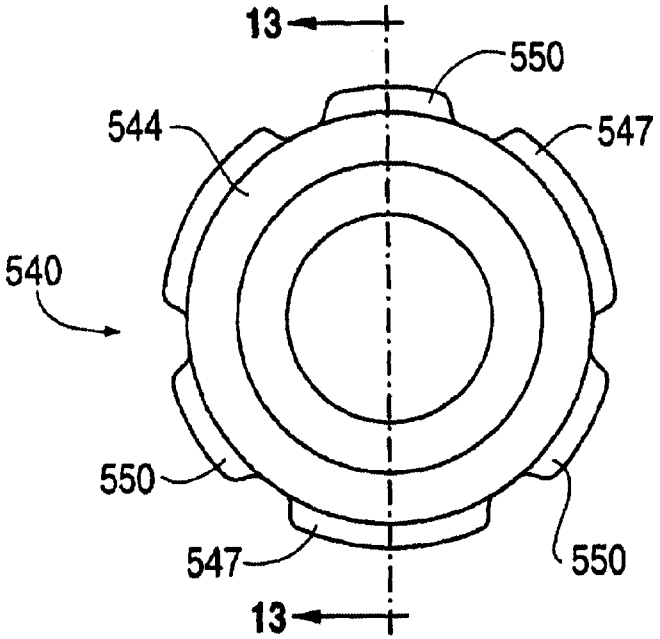
FIG. 12 illustrates an end view of a first inner sleeve of the adjustable member of FIG. 8.

In the illustrated embodiment, ends 522 and 532 of the tubes 520 and 530 are fixedly coupled together. Inner sleeve 540 is configured to further couple the ends 522 and 532. As illustrated in FIGS. 12–13, the inner sleeve 540 includes a first end 542, a second end 544, and a passageway 548 extending between the first end 542 and the second end 544.

As illustrated, inner sleeve 540 also includes end protrusions 547 and center protrusions 550. End protrusions 547 are located on the outer surface of sleeve 540 proximate to end 542 and extend radially outwardly from sleeve 540. End protrusions form a contact surface that is engaged by end 522 of the outer tube 520. The inner sleeve 540 has a radially inward extending flange 546 that abuts the end 532 of the inner tube 530. Thus, when inner sleeve 540 is coupled to inner tube 530, the sleeve 540 prevents the outer tube end 522 from moving outwardly beyond the inner tube end 532.

In the illustrated embodiment, the sleeve 540 includes three end protrusions 547 that are equally spaced around the circumference of the inner sleeve 540. In this arrangement, each end protrusion 547 extends approximately 35° around the circumference of the sleeve 540. The center of each end protrusion 547 may be separated from the center of an adjacent end protrusion by approximately 120°. While three protrusions are illustrated, the inner sleeve 540 may include any number of protrusions spaced any distance apart. The inner sleeve 540 may include a single continuous end protrusion extending around its outer surface.

Center protrusions 550 are located on the outer surface of the sleeve 540 proximate to the midpoint of the sleeve 540. The center protrusions 550 are used to prevent any relative movement between the outer tube 520 and the inner tube 530. The center protrusions 550 engage notches 526 formed in the outer tube 520. When the inner sleeve 540 is coupled to the inner tube 530, the engagement of the center protrusions 550 and the notches 526 prevent any longitudinal relative movement between the tubes 520 and 530.

In the illustrated embodiment, inner sleeve 540 includes three center protrusions 550. The center protrusions 550 are located on the outer surface of the sleeve 540 and are equally spaced around the circumference of the inner sleeve 540. In this embodiment, the center protrusions 550 are spaced apart in the same arrangement as the end protrusions as described above. The center protrusions 550 may be radially offset from the end protrusions as illustrated. While three center protrusions are illustrated, inner sleeve 540 may include any number of center protrusions with any sized spacing therebetween.

Figure 15:
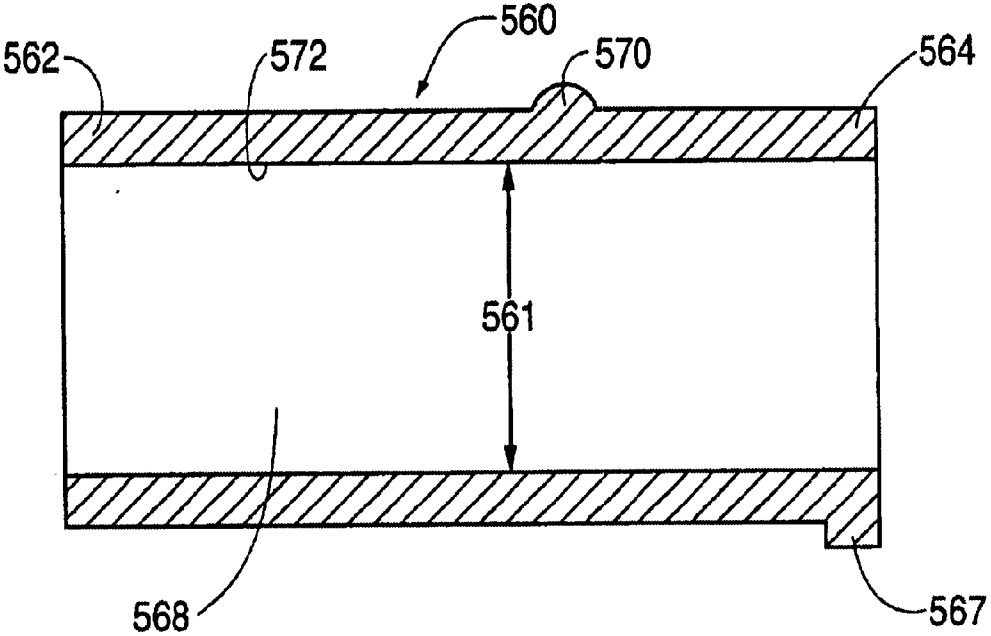
FIG. 15 illustrates a cross-sectional side view of the second inner sleeve of FIG. 14 taken along the line 15—15 of FIG. 14.
Figure 14:
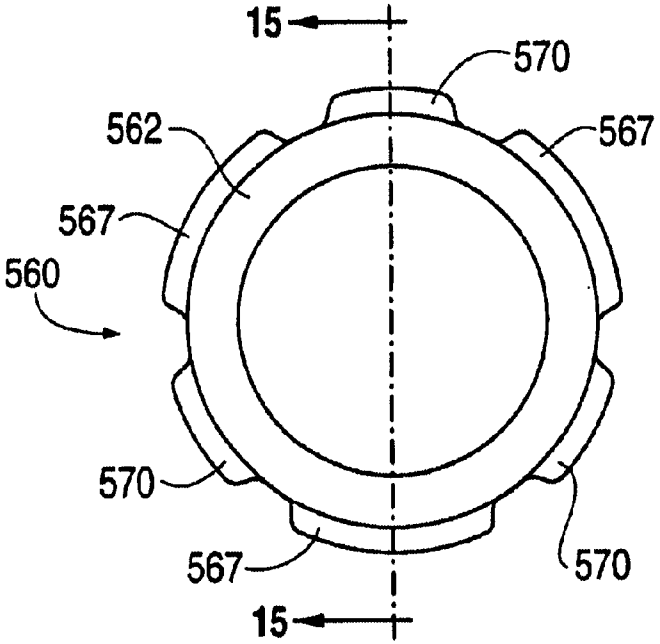
FIG. 14 illustrates an end view of a second inner sleeve of the adjustable member of FIG. 8.

In the illustrated embodiment, ends 524 and 534 move relative to each other. Inner sleeve 560 is configured to allow for the relative movement of ends 524 and 534. As illustrated in FIGS. 14–15, the inner sleeve 560 includes a first end 562, a second end 564, and a passageway 568 that extends between the first end 562 and the second end 564.

In this embodiment, the inner sleeve 560 includes end protrusions 567 and center protrusions 570, similar to those on inner sleeve 540. End protrusions 567 are located proximate to the end 524 of the outer tube 520. End protrusions 567 form a sheath-like structure around the end 524. Center protrusions 570 engage notches 526 formed in the outer tube 520 to couple longitudinally the inner sleeve 560 and the outer tube 520. The number and locations of the end protrusions 567 and the center protrusions 570 are approximately the same as those discussed relative to the end protrusions 547 and the center protrusions 550 on inner sleeve 540.

Inner sleeve 560 also includes an inner surface 572 that defines an inside diameter 561 (see FIG. 15). The inner surface 572 of inner sleeve 560 has two tapered surfaces that extend from the middle of the sleeve 560 to the ends 562 and 564. The middle of the sleeve 560 has a larger thickness than the ends 562 and 564. Thus, the inside diameter of the sleeve 560 decreases from the ends 562 and 564 to the midpoint of the sleeve 560. The tapered surface reduces the amount of contact and friction between the inner surface 572 of the inner sleeve 560 and other adjacent components of the hoop.

In this embodiment, the range that the adjustable member 510 can be lengthened and the hoop diameter can be increased is limited. The adjustable member 510 includes a plug 580 coupled to end 534 of the inner tube 530. As the ends of the outer tube 520 are pulled apart, end 534 of the inner tube 530 is pulled inwardly toward the center of the outer tube 520. As the inner tube 530 moves inwardly, the plug 580 engages inner sleeve 560 and limits the movement of the inner tube 530.

As illustrated in FIG. 9, the plug 580 includes a first end 582, a second end 584, and a flange or retaining member 586. The flange 586 extends radially outwardly from the second end 584 of the plug 580. The outer perimeter 587 of the flange 586 defines a diameter 588. The plug 580 is coupled to the second end of the inner tube 530 via a fastener.

The plug 580 can be connected to the inner tube 530 in a variety of configurations that enable the plug 580 to engage the inner sleeve 560 and limit the movement of the inner tube 530. For example, a portion of the plug 580 can be located within the passageway 536 of the inner tube 530. Alternatively, the plug 580 can be located along the outer surface of the inner tube 530.

In the illustrated embodiment, the adjustable member 510 also includes outer sleeves 600 and 610. The outer sleeves 600 and 610 cover corresponding ends 504 and 506 of the arcuate member 502, respectively, to prevent the ends 504 and 506 from catching on material, such as clothing, or pinching the user. The outer sleeves 600 and 610 also limit the extent to which the ends of the outer tube 520 slide out of engagement with the arcuate member 502.

Figure 11:
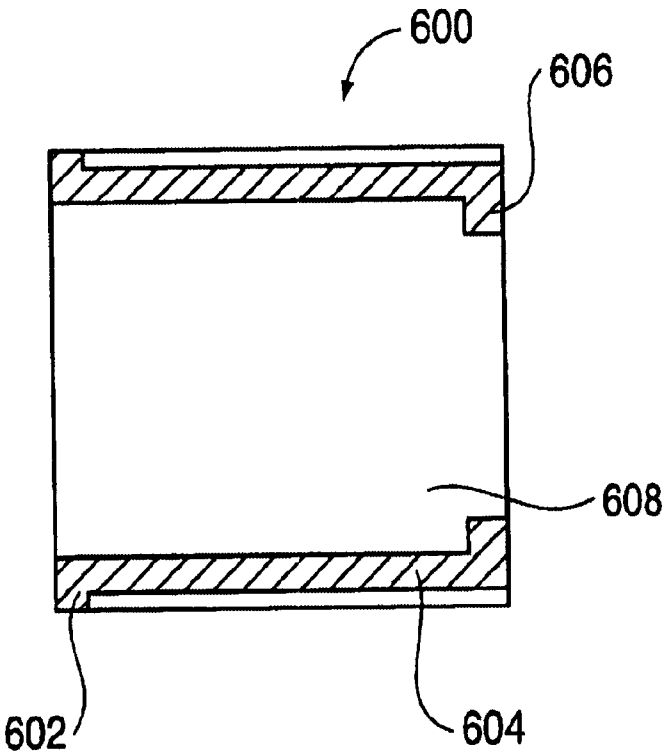
FIG. 11 illustrates a cross-sectional side view of the outer sleeve of FIG. 10 taken along the line 11—11 in FIG. 10.
Figure 10:
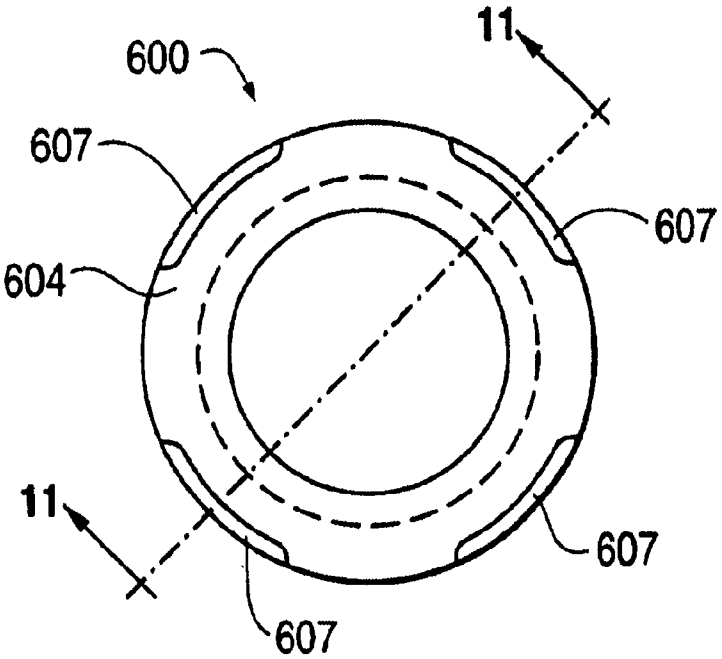
FIG. 10 illustrates an end view of an outer sleeve of the adjustable member of FIG. 8.

Outer sleeve 600 is coupled to and covers end 504 of the arcuate member 502. Outer sleeve 610 is coupled to and covers end 506 of the arcuate member 502. Each outer sleeve is a substantially cylindrical hollow tube. Outer sleeve 600 is structurally similar to outer sleeve 610. As illustrated in FIGS. 10–11, outer sleeve 600 includes ends 602 and 604, an inwardly extending flange 606, and has a passageway 608 extending therethrough. Outer sleeve 610 includes ends 612 and 614, an inwardly extending flange 616, and a passageway 618 extending therethrough.

As illustrated in FIG. 9, the outer tube 520 includes ridges formed in its non-corrugated portion. The ridges extend radially outwardly from the outer surface of the non-corrugated portion. A recess corresponds to each ridge along the inner surface of the non-corrugated portion. Each end of the outer tube 520 includes one or more ridges near one end of the non-corrugated portion and one or more ridges 526 proximate to the middle of the non-corrugated portion.

The recesses on the non-corrugated portion are engaged by the center protrusions on the inner sleeves. The engagement of the protrusions and the recesses prevents movement of the inner sleeves 540 and 560 relative to the outer tube 520. In particular, center protrusion 550 on sleeve 540 and center protrusion 570 on sleeve 560 engage corresponding recesses in the outer tube 520.

The end ridges on the outer tube 520 engage the outer sleeves 600 and 610 to prevent the outer tube 520 from withdrawing from the cavity of the arcuate member 502. End ridge 521 engages the inner flange 606 on outer sleeve 600. Similarly, end ridge 523 on the other end of the outer tube 520 engages the inner flange 616 on outer sleeve 610.

In this embodiment, ridges 521 and 523 are formed on the outer surface of the outer tube 520 and can be spaced apart in a similar pattern as end protrusions and center protrusions on the sleeves. In an alternative embodiment, the outer tube can have a continuous ridge around the circumference of the outer tube 520.

The assembly of the components of the hoop 500 is now discussed. As illustrated, the outer sleeve 600, the arcuate member first end 504, the outer tube first end 522, the inner sleeve 540, and the inner tube first end 532 are fixedly coupled together. The second end 534 of the inner tube 530 is slidably coupled to the second end 506 of the arcuate member 502. The outer sleeve 610, the arcuate member second end 506, the outer tube second end 534, and the inner sleeve 560 are fixedly coupled together.

Particular components of the hoop are sized to allow movement relative to each other. As illustrated in FIG. 9, the second end 534 of the inner tube 530, including the plug 580, is disposed within the cavity 508 of the arcuate member 502. The outer diameter 588 of the plug flange 586 is substantially the same as the inner diameter of the arcuate member 502. Similarly, the diameter 561 of the middle portion of the inner sleeve 560 is substantially the same as the outer diameter 539 of the inner tube 530. In another embodiment, the diameter 561 of the middle portion of the inner sleeve 560 is slightly less than the outer diameter 539 of the inner tube 530.

In the illustrated embodiment, the strength of the corrugated portion 516 of the outer tube 520 provides sufficient rigidity to retain the adjustable member 510 and the hoop 500 in particular configurations. The corrugated portion 516 prevents undesired shortening or lengthening of the adjustable member 510. In an alternative embodiment, frictional forces between the plug flange 586 and the arcuate member inner surface 509 and between the inner sleeve 560 and the inner tube outer surface 538 provide stability to retain the hoop in a particular configuration.

Now a process of adjusting the length of the adjustable member is discussed. As a user moves the ends 504 and 506 of the arcuate member 502 toward each other, the length of the adjustable member 510 is shortened and the diameter of the hoop 500 decreases. This relative movement collapses some of the corrugations 517 and shortens the length of the outer tube 520. Simultaneously, the inner tube 530 moves further into the cavity 508 of the arcuate member 502.

As a user moves the ends 504 and 506 of the arcuate member 502 away from each other, the length of the adjustable member 510 increases and the diameter of the hoop 500 increases. This relative movement expands some or all of the collapsed corrugations 517. Simultaneously, the inner tube 530 moves relative to the arcuate member 502 and less of the inner tube 530 extends into the cavity 508 of the arcuate member 520 (see FIG. 9). The plug flange 586 is configured to contact the end 564 of sleeve 560 to retain part of the inner tube 530 within the arcuate member cavity 508. This arrangement also limits the extent to which the adjustable portion 510 can be lengthened.

As discussed relative to the other embodiments, conventional coupling mechanisms can be used to couple various combinations of components of the hoop. Any type of connector, including a fastener, such as staples 630, 632, and 634 (see FIG. 9), or an adhesive may be used to coupled particular components together. Alternatively, any conventional bonding process, such as sonic welding, may be used.

In the illustrated embodiment, the outer surfaces of the outer sleeves 600 and 610 include recesses 607 (see FIGS. 10–11 which illustrate recesses only for outer sleeve 600). The recesses 607 are provided to prevent any portion of a fastener from extending beyond the outer surface profile of the outer sleeves. In an alternative embodiment, the outer surfaces of the outer sleeves do not include any such recesses.

The following dimensions are provided for an exemplary hoop according to the present invention and are not intended to be limiting in any way:

Hoop diameter (collapsed to expanded)=40.6 to 50.8 cm (16 to 20 in.)

Arcuate member:

Linear length=248.9 cm (98 in.)

Outside diameter=2.1 cm (0.8 in.)

Inside diameter=1.9 cm (0.7 in.)

Outer tube:

Length of corrugated portion (collapsed to expanded)=12.7 to 63.5 cm (5 to 25 in.)

Thickness of corrugated portion=0.05–0.06 cm (0.02–0.025 in.)

Length of non-corrugated portions (at each end)=2.3 cm (0.9 in.)

Outside diameter of non-corrugated portion=1.8 cm (0.7 in.)

Height of ridges of the non-corrugated portion=0.05 cm (0.02 in.)

Inner tube:

Linear length=68.6 cm (27 in.)

Outside diameter=1.3 cm (0.5 in.)

Inside diameter=0.9 cm (0.3 in.)

Inner sleeve length=2.5 cm (1 in.)

Inner sleeve length=2.2–3.2 cm (0.9–1.3 in.)

While conventional hoops are circular this invention can be used with any annular shape, such as an ellipse or a polygon with any number of sides.

Each component of the hoop is made of a molded plastic material, such as a low density polyethylene or a low density polypropylene. Alternatively, any material with sufficient rigidity to retain its position can be used.

In alternative embodiments, the adjustable member can include other mechanisms or structures to facilitate the lengthening and shortening of the adjustable member and the inner tube and the outer tube of the adjustable member can have variable or adjustable lengths.

In other embodiments, the components of the hoop that slide relative to one another can be sized to vary the amount of friction present between the components.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A hoop comprising:

an arcuate member, said arcuate member having a first end and a second end; and an adjustable member coupled to said arcuate member, said adjustable member being selectively disposable in an extended configuration and in a collapsed configuration, said adjustable member having a first length in said extended configuration and a second length in said collapsed configuration, said first length being different from said second length, and a first end and a second end, said first end of said adjustable member being coupled to said first end of said arcuate member, and said second end of said adjustable member being coupled to said second end of said arcuate member.

2. The hoop of claim 1, wherein said first end of said adjustable member is fixedly coupled to said first end of said arcuate member, and said second end of said adjustable member is slidably coupled to said second end of said arcuate member.

3. The hoop of claim 1, wherein said adjustable member includes an outer tube and an inner tube disposed within said outer tube, said inner tube having a fixed length and said outer tube having a variable length.

4. The hoop of claim 3, wherein said outer tube has a first end and a second end, said outer tube first end being fixedly coupled to said arcuate member first end, and said outer tube second end being fixedly coupled to said arcuate member second end.

5. The hoop of claim 4, wherein said inner tube has a first end and a second end, said inner tube first end being fixedly coupled to said arcuate member first end, and said inner tube second end being slidably coupled to said arcuate member second end.

6. The hoop of claim 3, wherein said outer tube has a first end and a second end, and said inner tube has a first end and a second end, said adjustable member further comprising:

a first sleeve coupled to said outer tube second end and said arcuate member second end, said first sleeve including a flange portion; and a second sleeve coupled to said inner tube second end, said second sleeve including a flange portion, said first sleeve flange portion being engageable with said second sleeve flange portion.

7. The hoop of claim 6, wherein said first sleeve flange portion extends radially inwardly and said second sleeve flange portion extends radially outwardly.

8. The hoop of claim 6, wherein said inner tube has an outer surface and said first sleeve flange portion slidably engages said inner tube outer surface.

9. The hoop of claim 8, wherein said first sleeve flange portion defines an opening through which said inner tube is inserted, said opening having a diameter, said inner tube outer surface having a diameter, said inner tube outer surface diameter being substantially equal to said opening diameter.

10. The hoop of claim 8, wherein said arcuate member is a hollow tube having an inner surface defining a diameter, said second sleeve flange portion defining an outer diameter, said arcuate member diameter being substantially equal to said second sleeve flange portion outer diameter.

11. The hoop of claim 1, wherein said adjustable member includes a corrugated section.

12. A hoop comprising:

a substantially annular body having:

a fixed length portion, said fixed length portion being arcuate; and an adjustable length portion, said adjustable length portion having a first end and a second end, said adjustable length portion being continuous between said first end and said second end, each of said first end and said second end being coupled to said fixed length portion, said adjustable length portion including corrugations disposed between said first end and said second end, said adjustable length portion being disposable in a first configuration and a second configuration, said body having a first diameter when said adjustable length portion Is in said first configuration and a second diameter when said adjustable length portion is in said second configuration, said first diameter being different than said second diameter.

13. The hoop of claim 12, wherein a majority of said annular body is said fixed length portion.

14. A hoop comprising:

a substantially annular body having:

a fixed length portion;

an adjustable length portion, said adjustable length portion having a first end and a second end, said adjustable length portion being continuous between said first end and said second end, each of said first end and said second end being coupled to said fixed length portion, said adjustable length portion being disposable in a first configuration and a second configuration, said body having a first diameter when said adjustable length portion is in said first configuration and a second diameter when said adjustable length portion is in said second configuration, said first diameter being different than said second diameter; and a tube, said tube disposed within a portion of said adjustable length portion, said tube having a first end and a second end, said tube first end being coupled to said fixed length portion and said adjustable length portion, and said tube second end being movable relative to said fixed length portion and said adjustable length portion.

15. The hoop of claim 14, further comprising:

a first retaining member coupled to said fixed length portion and said adjustable length portion; and a second retaining member coupled to said tube, said second retaining member being engageable with said first retaining member to limit adjustment of the length of said adjustable length portion.

16. The hoop of claim 14, wherein said adjustable length portion includes corrugations disposed between said first end and said second end.

17. A method of varying a diameter of a hoop, the hoop including a fixed length member and an adjustable length member, the fixed length member having a first end and a second end, the adjustable length member having a first end and a second end, the adjustable length member having a variable length between its first and second ends, the first ends of the fixed length member and the adjustable length member being coupled together, and the second ends of the fixed length member and the adjustable length member being coupled together, the method comprising the step of:

moving the first end of the adjustable length member relative to the second end of the adjustable length member.

18. The method of claim 17, wherein said moving the first end includes moving the first end of the adjustable length member away from the second end of the adjustable length member, thereby lengthening the adjustable length member and increasing the diameter of the hoop.

19. The method of claim 18, further comprising the step of:

moving the first end of the adjustable length member closer to the second end of the adjustable length member, thereby shortening the adjustable length member and decreasing the diameter of the hoop.

20. The method of claim 17, wherein said adjustable length member includes a plurality of corrugations, and said moving the first end includes collapsing the plurality of corrugations.

21. The method of claim 20, wherein said moving the first end includes expanding the plurality of corrugations.

* * * * *